US005181856A

United States Patent [19]

Vente et al.

[11] Patent Number: 5,181,856

[45] Date of Patent: Jan. 26, 1993

[54] CABLE PLUG FOR SPARK PLUGS

[75] Inventors: Paul Vente, Leverkusen; Achim Wolfgarten, Köln, both of Fed. Rep. of Germany

[73] Assignee: Bayer Aktiengesellschaft, Leverkusen, Fed. Rep. of Germany

[21] Appl. No.: 807,301

[22] Filed: Dec. 13, 1991

[30] Foreign Application Priority Data

Jan. 18, 1991 [DE] Fed. Rep. of Germany ..... 4101375

[51] Int. Cl.[5] ..... H01R 13/52

[52] U.S. Cl. ..... 439/125; 439/279

[58] Field of Search ..... 439/279, 274, 275, 587, 439/125

[56] References Cited

U.S. PATENT DOCUMENTS

| | | | |
|---|---|---|---|
| 1,898,064 | 2/1933 | Ridge | 439/125 |
| 2,707,723 | 5/1955 | Moorhead | 174/153 G |
| 2,934,668 | 4/1960 | Dall | 313/135 |
| 4,697,861 | 10/1987 | Mitchell | 439/587 |
| 4,875,875 | 10/1989 | Archer et al. | 439/465 |
| 4,947,809 | 8/1990 | Hocking | 439/125 |
| 4,997,380 | 3/1991 | Etienne et al. | 439/127 |

*Primary Examiner*—Gary F. Paumen

*Attorney, Agent, or Firm*—Sprung Horn Kramer & Woods

[57] ABSTRACT

The penetration of moisture between casing (1) and ignition cable (3) is avoided in cable plugs in that at least one seal ring (9) is provided, which as the ignition cable (3) is pushed in is squeezed into an annular shoulder (10) of the head section (6) and thereby forms a seal.

2 Claims, 1 Drawing Sheet

CABLE PLUG FOR SPARK PLUGS

Figure 1:
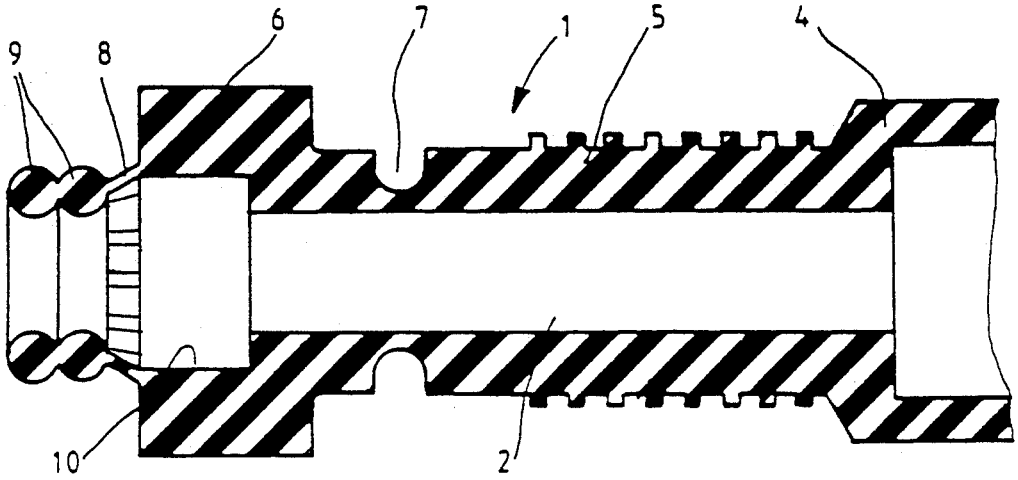

The invention relates to a cable plug for spark plugs, comprising a casing made of non-conductive, flexible plastics material, more particularly silicon, having a central duct for accommodating an ignition cable.

In cable plugs of this type there is a danger of moisture penetrating between the ignition cable and the casing of the cable plug. In order to avoid this, the cable plug casing usually comprises an elastic shoulder, which is intended to enclose the ignition cable on the entry side in a sealing-tight manner. However, it has been found that moisture often still penetrates through this gap to reach the spark plug.

It is the object of the invention to improve the cable plug of the above type in such a manner that a reliable seal against moisture is formed between the casing and ignition cable and a cable plug of this type can be simply manufactured in an injection molding process.

This object is attained in that, on the entry side for the ignition cable., the casing comprises at least one injection-molded seal ring at least originally connected via a film or webs with the casing and a coaxial annular shoulder for accommodating the seal ring, the internal diameter of the seal ring being smaller than the thickness of the ignition cable and the thickness of the seal ring being dimensioned in such a manner that it experiences a sealing deformation as it is pushed into the annular shoulder.

As a result of this design, as the ignition cable is pushed into the duct of the cable plug or casing, the seal ring is turned inwards as a result of the connecting film or webs and is pulled into the annular shoulder. As a result of the given geometry, the seal ring is thereby squashed to such a degree that the duct is completely sealed towards the inside. The seal ring or rings, depending on the design or molding tool, is/are formed simultaneously during the injection-molding of the new type of cable plug. The connecting film or webs have no function other than forming a unit from the casing and seal ring, so that additional handling or additional bearing mounts are dispensed with. It does not matter if the film or webs tear as the seal ring is turned inwards. However, if the film remains intact, it forms an additional seal between the circumferential wall of the annular shoulder and the seal ring.

The cable plug is preferably divided by a concentric annular groove into a shaft section and a head section, the roller ring being arranged on the head section and the annular shoulder being arranged inside the head section.

This annular groove can either be arranged on the outside or inside. As a result of the thereby intended reduced thickness in the region of the annular groove, the head section is provided with a certain degree of elasticity and resilience, in order to prevent cracks forming when the unit is vibrating.

Figure 2:
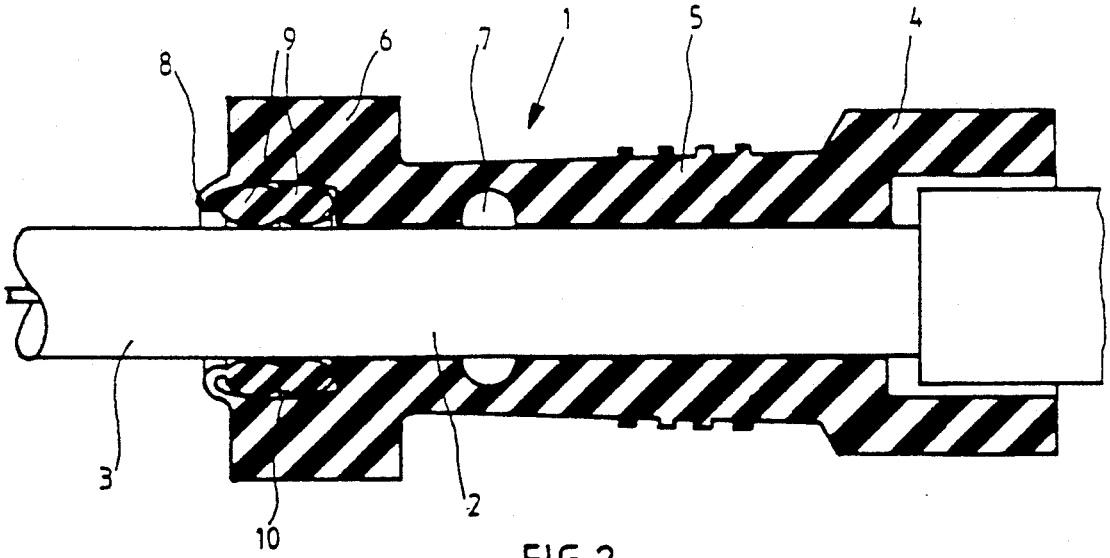

The new type of cable plug is explained in further detail in the following by way of an embodiment shown purely schematically in section in the drawings, in which:

FIG. 1 shows the cable plug without ignition cable, and FIG. 2 shows the cable plug with inserted ignition cable.

The cable plug comprises the casing 1 with an axial duct 2 for an ignition cable 3 (FIG. 2). This casing 1 is divided into a plug sleeve 4, a shaft section 5 and a head section 6. The shaft section 5 and head section 6 are defined relative to one another by means of an annular groove 7 (on the outside in FIG. 1 and arranged on the inside in FIG. 2 as an alternative). A pair of seal rings 9 extending into one another adjoins the head section 6 via a film or webs 8. Arranged in the head section 6 per se is an annular shoulder 10, which (FIG. 2) is intended to receive the seal rings 9.

The internal diameter of the seal ring pair 9 is somewhat smaller than the external diameter of the ignition cable 3, so that when the ignition cable 3 is pushed into the duct 2, the seal ring pair 9 is turned inward and pushed into the annular shoulder 10. In this respect, the seal rings 9 are compressed and seal the adjoining duct 2 or the gap between ignition cable 3 and casing 1 against moisture.

We claim:

1. A cable plug for spark plugs, comprising a casing (1) made of non-conductive, flexible plastics material, in particular silicon, having a central duct (2) for accommodating an ignition cable (3), characterized in that at an entry side for the ignition cable (3), the casing (1) comprises at least one injection-molded seal ring (9) connected via a film (8) or webs with the casing (1) and an internal, coaxial, annular shoulder (10) for accommodating the seal ring (9), the internal diameter of the roller ring (9) being smaller than the thickness of the ignition cable (3) and the thickness of the roller ring (9) being dimensioned in such a manner that it makes contact with, and experiences a sealing deformation as it is pushed against the annular shoulder (10).

2. A cable plug according to claim 1, characterized in that it is divided by a concentric annular groove (7) into a shaft section (5) and a head section (6), the seal ring (9) being arranged on the head section (6) and the annular shoulder (10) being arranged inside the head section (6).

* * * * *